US008083011B2

(12) United States Patent
Sreshta et al.

(10) Patent No.: US 8,083,011 B2
(45) Date of Patent: Dec. 27, 2011

(54) MATRIX TURBINE SLEEVE AND METHOD FOR MAKING SAME

(76) Inventors: Harold A. Sreshta, Conroe, TX (US); Hector Adrian Sanchez, Houston, TX (US); Eric F. Drake, Galveston, TX (US); Neerali Janubhai Desai, Houston, TX (US)

( * ) Notice: Subject to any disclaimer, the term of this patent is extended or adjusted under 35 U.S.C. 154(b) by 638 days.

(21) Appl. No.: 12/239,915

(22) Filed: Sep. 29, 2008

(65) Prior Publication Data

US 2010/0078222 A1 Apr. 1, 2010

(51) Int. Cl.
*E21B 17/04* (2006.01)
*E21B 17/046* (2006.01)

(52) U.S. Cl. ..... 175/325.2; 175/325.4

(58) Field of Classification Search ..... 175/325.1–325.5
See application file for complete search history.

(56) References Cited

U.S. PATENT DOCUMENTS

| | | | | |
|---|---|---|---|---|
| 3,419,094 | A | 12/1968 | Bobo | |
| 3,645,587 | A | 2/1972 | Parker | |
| 3,978,933 | A | 9/1976 | Olson et al. | |
| 4,000,549 | A | 1/1977 | Brumley et al. | |
| 4,982,802 | A | 1/1991 | Warren et al. | |
| 5,829,541 | A | 11/1998 | Flood et al. | |
| 5,875,862 | A | 3/1999 | Jurewicz et al. | |
| 6,213,229 | B1 * | 4/2001 | Majkovic | 175/325.2 |
| 6,742,611 | B1 | 6/2004 | Illerhaus et al. | |
| 7,435,478 | B2 | 10/2008 | Keshavan | |
| 7,533,740 | B2 | 5/2009 | Zhang et al. | |
| 7,681,669 | B2 | 3/2010 | Cannon et al. | |
| 7,694,757 | B2 | 4/2010 | Keshavan | |

FOREIGN PATENT DOCUMENTS

| | | | |
|---|---|---|---|
| DE | 19634314 | | 1/1998 |
| EP | 1116858 | | 7/2001 |
| EP | 1190791 | | 3/2002 |
| GB | 2147033 A | * | 5/1985 |
| GB | 2270492 | | 3/1994 |

* cited by examiner

*Primary Examiner* — Giovanna Wright
(74) *Attorney, Agent, or Firm* — Jeffery Daly; The JL Salazar Law Firm

(57) ABSTRACT

A turbine matrix sleeve in accordance with the invention includes an inner cylindrical structure made up of a first material. The inner cylindrical structure may include multiple blades and multiple channels running between the blades along an outside diameter thereof. The inner cylindrical structure further includes threads, such as right-hand or left-hand threads, on an outer surface thereof. An outer layer, made up of a second material different from the first material, is integrally bonded to the threads. This outer layer may be optionally embedded with hardened inserts or buttons, such as PDC inserts, diamond inserts, TSP inserts, or the like. The threaded surface on the inner cylindrical structure significantly improves the bond between the outer layer and the inner cylindrical structure and creates a mechanical lock therebetween.

24 Claims, 5 Drawing Sheets

MATRIX TURBINE SLEEVE AND METHOD FOR MAKING SAME

BACKGROUND OF THE INVENTION

1. Field of the Invention

This invention relates to downhole drilling and more particularly to downhole turbine sleeves and methods for making downhole turbine sleeves.

2. Description of the Related Art

Downhole drilling environments present some of the harshest conditions on the planet. Materials able to withstand these conditions are thus critical to the performance of downhole tools.

Historically, the oil and gas industry has relied primarily on steel for manufacturing downhole tools. With the advent of high speed turbines, as well as harsher drilling environments, higher stresses and strains are being placed on downhole tools. Accordingly, materials that exceed the durability of steel are needed in many applications, particularly in drill bits and turbine sleeves placed adjacent to drill bits.

In some applications, a turbine sleeve may be placed adjacent to a downhole drill bit. A turbine sleeve is typically a substantially cylindrical structure with a series of blades running along its outside diameter and contacting the borehole. A series of channels running between the blades allow drilling fluids to pass by the sleeve. The turbine sleeve extends the gauge portion of the drill bit and is helpful to reduce lateral movement of the drill bit and prevent the hole from going undergauge.

The sleeve may also reduce vibration and hole-spiraling in order to provide a consistently smooth, concentric borehole. The smoothness of the borehole may be critical to placing casing and obtaining accurate logging data. The sleeve may improve rate-of-penentration (ROP) and bit life, thereby extending drilling time and decreasing tripping frequency.

Typical turbine sleeves may be may be made of various materials or combinations of materials. In some cases, turbine sleeves may include an internal steel structure that is coated with a matrix material, such as a tungsten carbide matrix. Nevertheless, conventional matrix-coated sleeves are known to be susceptible to blade fractures at the matrix/steel interface due to residual, mechanical, and thermal loading, thereby significantly limiting their service life.

In view of the foregoing, what are needed are improved matrix-coated turbine sleeves that are less susceptible to blade fractures and that can better withstand residual, mechanical, and thermal loading. Further needed are improved methods for making matrix-coated turbine sleeves.

SUMMARY OF THE INVENTION

The present invention provides a novel turbine matrix sleeve and method for making same. The features and advantages of the present invention will become more fully apparent from the following description and appended claims, or may be learned by the practice of the invention as set forth hereinafter.

In a first embodiment of the invention, a turbine matrix sleeve in accordance with the invention includes an inner cylindrical structure made up of a first material. The inner cylindrical structure may include multiple blades and multiple channels running between the blades along an outside diameter thereof. The inner cylindrical structure further includes threads, such as right-hand or left-hand threads, on an outer surface thereof. An outer layer, made up of a second material different from the first material, is integrally bonded to the threads. This outer layer may be optionally embedded with hardened inserts or buttons, such as PDC inserts, diamond inserts, TSP inserts, or the like. The threaded surface on the inner cylindrical structure significantly improves the bond between the outer layer and inner cylindrical structure and creates a mechanical lock between the outer layer and inner cylindrical structure.

In selected embodiments, the blades are substantially parallel to or helical with respect to an axis of the inner cylindrical structure. In certain embodiments, the inner cylindrical structure is made of steel and the outer layer is made of a matrix material. For example, the matrix material may be a tungsten carbide matrix material. Similarly, in certain embodiments, the outer layer is made of a material that is harder or more durable than the material of the inner cylindrical structure. In certain embodiments, the outer layer makes up about 5 to 95 percent of the blade height. In other embodiments, the outer layer makes up about 30 percent of the blade height.

In another embodiment, a method in accordance with the invention may include providing an inner cylindrical structure made up of a first material. The method may then include forming multiple blades and multiple channels running between the blades along an outside diameter of the inner cylindrical structure. The method may also include forming threads on an outer surface of the plurality of blades. The method may include forming the threads prior to or after forming the blades and channels on the inner cylindrical structure. Once the threads are formed, the method may include integrally bonding, to the threads, an outer layer made up of a second material different from the first material. Optionally, the method may include embedding buttons or inserts, such as PDC inserts, diamond inserts, TSP inserts, or the like into the outer layer.

In yet another embodiment, an apparatus in accordance with the invention may include an inner cylindrical structure made up of a first material. The inner cylindrical structure may have threads on an outer diameter thereof. An outer layer, made up of a second material different from the first material, may be integrally bonded to the threads. Multiple blades and channels running between the blades may be formed on an outer surface of the outer layer. The channels may extend exclusively into the outer layer or, alternatively, through the outer layer and into the inner cylindrical structure.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of the embodiments of apparatus and methods in accordance with the present invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
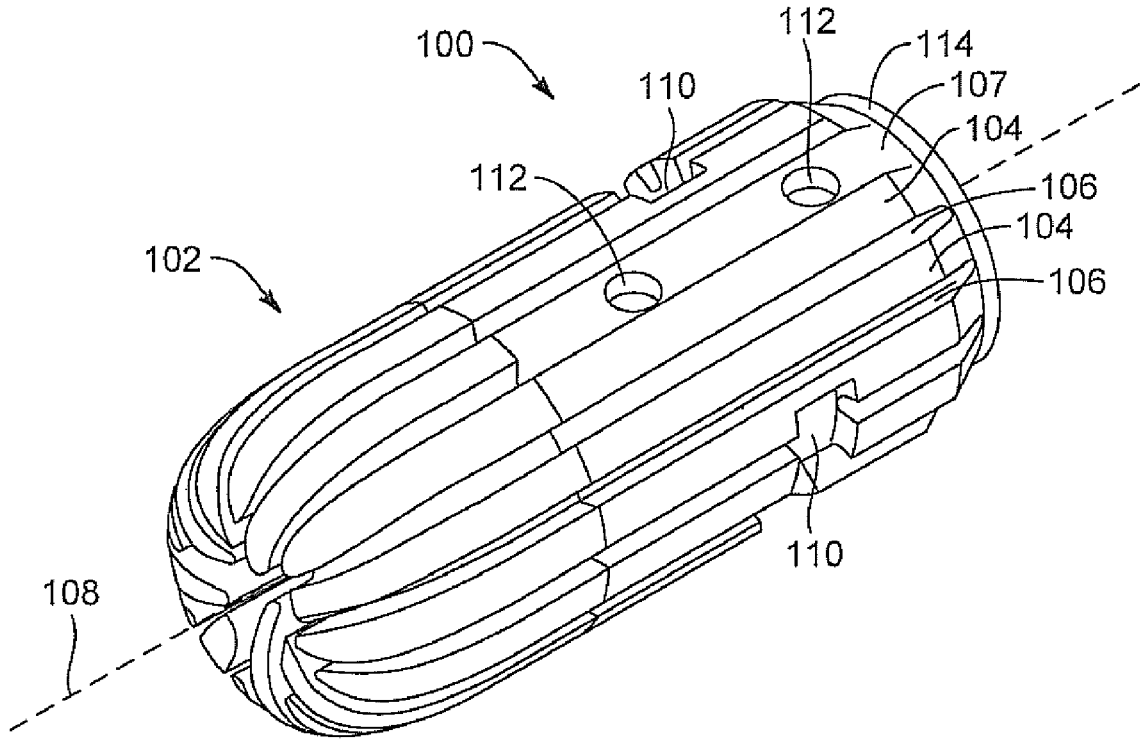
FIG. 1 is a perspective view of one embodiment of a turbine sleeve in accordance with the invention, connected to a drill bit.
Figure 2:
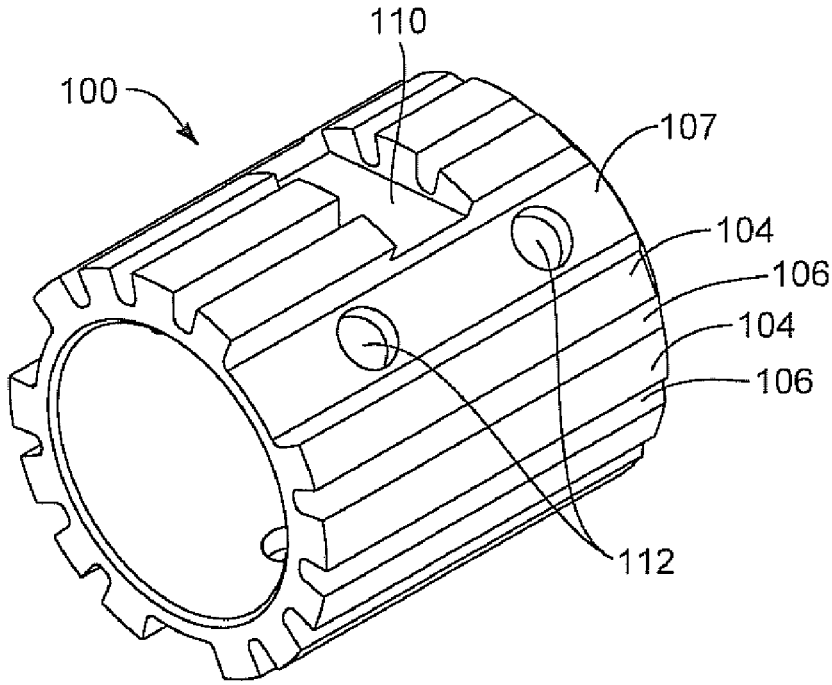
FIG. 2 is a perspective view of one embodiment of a turbine sleeve in accordance with the invention.

Referring to FIGS. 1 and 2, one embodiment of a downhole turbine sleeve 100 in accordance with the invention is illustrated. FIG. 1 shows a turbine sleeve 100 attached to a drill bit 102 and FIG. 2 shows the turbine sleeve 100 by itself. In selected embodiments, the turbine sleeve 100 may be a substantially cylindrical structure with a series of blades 104 running along an outside diameter thereof. The blades 104 may contact the borehole and extend the gauge portion (i.e., the outer diameter) of the drill bit 102. In the illustrated embodiment, the blades 104 are substantially parallel with respect to an axis 108 of the turbine sleeve 100. However, in other embodiments, the blades 104 may be slanted or helical with respect to the axis 108. A series of channels 106 may run between the blades 104 to allow drilling fluids, cuttings, or other materials to flow past the turbine sleeve 100 along the borehole.

As previously mentioned, the turbine sleeve 100 may provide various benefits in downhole drilling applications. For example, the turbine sleeve 100 may reduce lateral movement of the drill bit 102 by providing stiffness support thereto. The turbine sleeve 100 may also reduce vibration and hole spiraling in order to provide a consistently smooth, concentric borehole. The turbine sleeve 100 may improve rate-of-penetration (ROP) and bit life. These benefits may extend drilling time and decrease tripping frequency.

In selected embodiments, the blades 104 and channels 106 of the turbine sleeve 100 may align with corresponding blades or channels of the drill bit 102 to provide a path for fluids and cuttings to pass by the turbine sleeve 100. In certain embodiments, one or more blades 104 may be omitted to provide wider channels 107 along the turbine sleeve 100, thereby provided additional space for drilling fluids or cuttings to pass by the turbine sleeve 100. A breaker slot 110 may enable a tool or fixture to grab and apply torque to the turbine sleeve 100 when making up the drill bit 102. In certain embodiments, one or more weld holes 112 may be provided in the turbine sleeve 100. These weld holes 112 may be filled with a weld material to connect the sleeve 100 to an extension member 114 connecting the sleeve 100 to the drill bit 102. The extension member 114 may include internal threads (e.g., standard API connection threads) to connect the drill bit 102 and turbine sleeve 100 to other drill tools (e.g., a motor or turbine).

Figure 3:
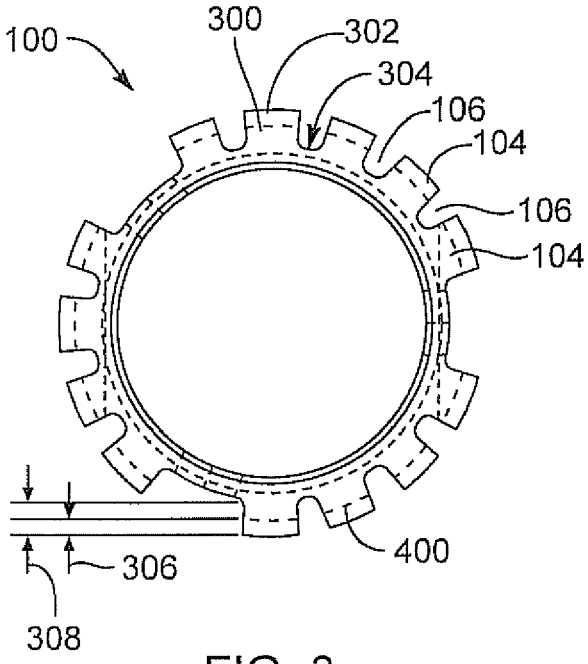
FIG. 3 is an end view of the turbine sleeve illustrated in FIG. 2.
Figure 4:
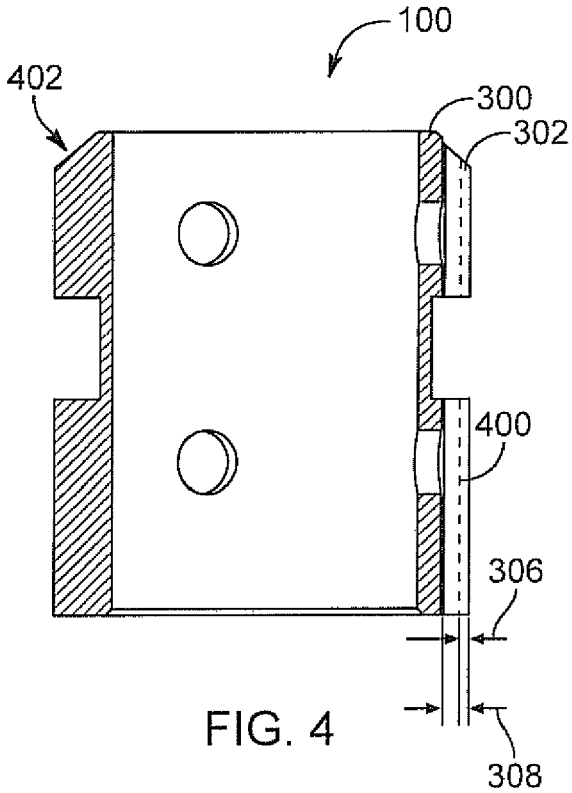
FIG. 4 is a cross-sectional side view of the turbine sleeve illustrated in FIG. 2.

Referring to FIGS. 3 and 4, in selected embodiments, a turbine sleeve 100 in accordance with the invention may include an inner cylindrical structure 300 made of a material such as steel. A more durable outer layer 302 may be adhered or attached to the outside diameter of the inner cylindrical structure 300. For example, a matrix material such as a layer 302 of tungsten carbide matrix may be attached to the outside diameter of the inner cylindrical structure 300 to provide added hardness or durability to the turbine sleeve 100. In another example, the matrix material may include an impreg matrix containing 10 to 40 percent diamond grit by volume. To improve the bond between the outer layer 302 and the inner cylindrical structure 300, a matrix layer containing a transition constituent may be used.

In certain embodiments, the outer layer 302 maybe embedded with inserts or buttons, such as tungsten carbide buttons, polycrystalline diamond compact (PDC) buttons, diamond inserts, PDC inserts, thermally stable polycrystalline diamond inserts (TSPs), natural diamonds, or the like, to improve the hardness or durability of the outer layer 302. The outer layer 302 may also receive durability enhancements such as impreg mix, brazed in PDC cutters on the blades 104, and/or PDC cutters on the back angle 402 to act as upreamers.

In certain embodiments, the outer layer 302 may be localized to the blades 104, meaning that the outer layer 302 may not extend to the root 304 of each blade 104. This design may minimize residual stresses by not having the outer layer 302 fully cover the inner cylindrical structure 300. In selected embodiments, the thickness 306 of the outer layer 302 may be about ten to eighty percent of the overall blade height 308. In other embodiments, the thickness 306 of the outer layer 302 may be about thirty percent of the overall blade height 308. In general, the thickness of the outer layer 302 may be chosen to avoid undercutting of the softer steel beneath the outer layer 302. Nevertheless, in other embodiments, the outer layer 302 is not localized to the blades 104, but rather extends to the root 304 of each blade 104 and completely covers the inner cylindrical structure 300.

Figure 5:
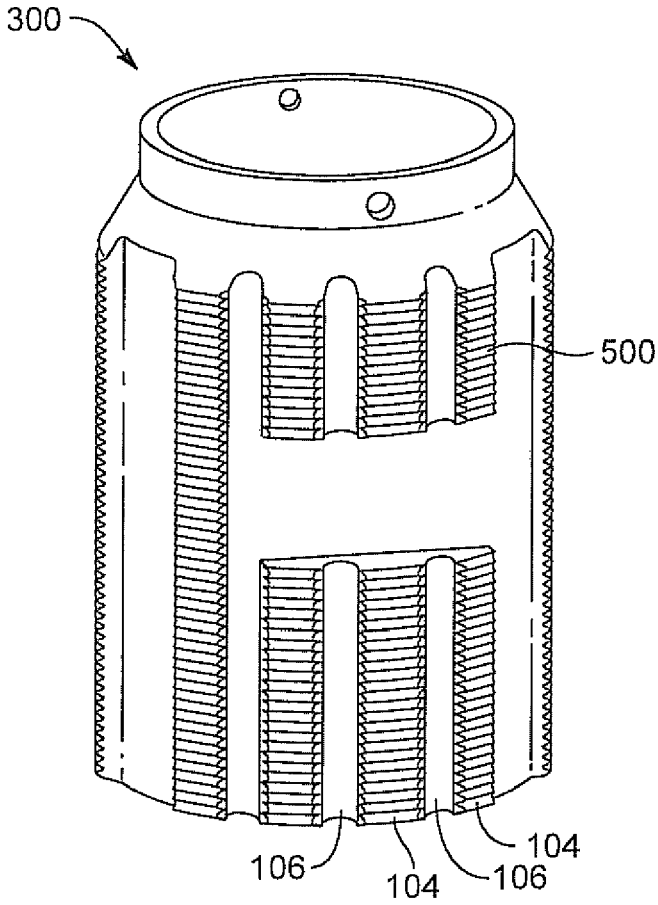
FIG. 5 is a perspective view of one embodiment of an inner cylindrical structure (or blank) for incorporation into a turbine sleeve in accordance with the invention.

Referring to FIG. 5, as previously mentioned, conventional matrix-coated turbine sleeves are known to be susceptible to blade fractures at the matrix/steel interface 400 due to residual, mechanical, and/or thermal loading, thereby significantly limiting the turbine sleeve's service life. Thus, apparatus and methods are needed to reduce the blades' susceptibility to fracture.

In order to address this problem, in selected embodiments, threads 500 (e.g., right-hand threads, left-hand threads) may be formed on the outside diameter of the inner cylindrical structure 300 prior to applying the outer layer 302 thereon. In this embodiment, a series of blades 104 and channels 106 are formed on the inner cylindrical structure 300 either before or after the threads 500 are formed thereon. The threads 500 may increase the surface area of the interface 400 and create a more gradual, as opposed to abrupt, transition from matrix material to steel. The threads 500 may also spread interfacial stress (due to compatibility strains, differences in coefficients of thermal expansion, etc.) over a wider area, thereby reducing the peak stresses experienced at the interface. This may significantly reduce the outer layer's tendency to separate or fracture from the underlying inner cylindrical structure 300. This improvement has been verified in high-speed turbine applications.

Another advantage of the threads 500 is that they may create a mechanical lock between the outer layer 302 and the inner cylindrical structure 300, thereby preventing separation due to tangential or thermal loading. In certain embodiments, the direction of the threads 500 may be selected based on the rotational direction of the drill bit 102. One additional advantage of using threads 500 as opposed to other textured surfaces is the ease of forming the threads 500 on the inner cylindrical structure 300 using a lathe or other appropriate machine tool.

Figure 6:
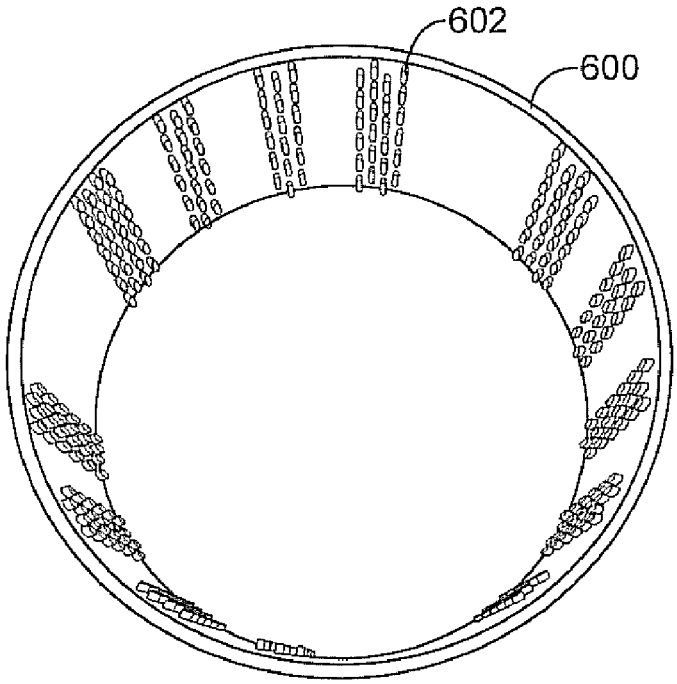
FIG. 6 is a perspective view of one embodiment of a mold sleeve, having hardened or durable inserts adhered to an inside diameter thereof, used for fabricating the turbine sleeve.

Referring to FIG. 6, in order to fabricate the turbine sleeve 100, a mold sleeve 600, such as a graphite mold sleeve 600, may be provided. The inside diameter of the mold sleeve 600 may be designed such that it is substantially equal to a desired outside diameter of the turbine sleeve 100. If inserts 602 or buttons 602 (e.g., PDC buttons, diamond inserts, PDC inserts, TSPs, natural diamonds, or the like) are to be embedded within the blades 104 of the turbine sleeve 100, these buttons 602 or inserts 602 may be glued or adhered to the inside diameter of the mold sleeve 600 at locations that will align with the blades 104 of the inner cylindrical structure 300. The mold sleeve 600 may provide a temporary form for the matrix material (i.e., the outer layer 302) that is deposited on the inner cylindrical structure 300.

Figure 7:
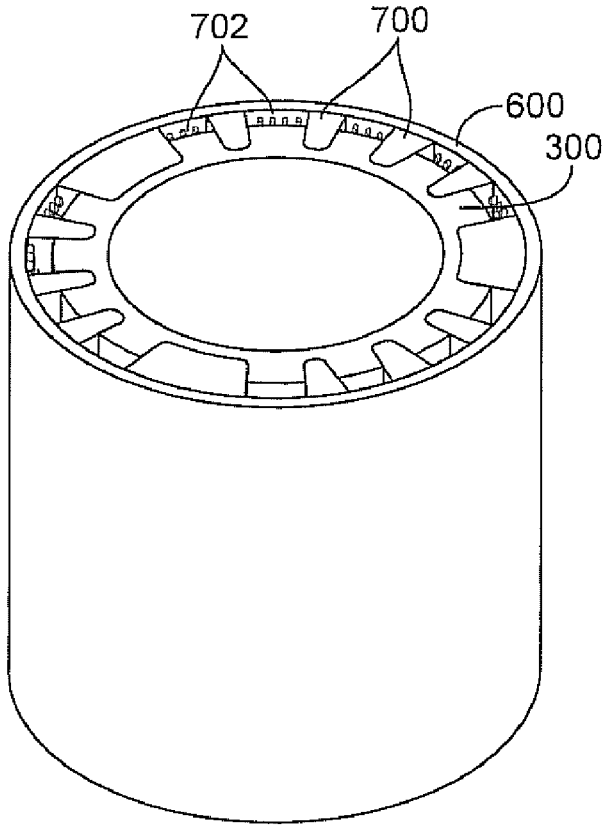
FIG. 7 is a perspective view showing the mold sleeve surrounding the inner cylindrical structure of FIG. 5.

Referring to FIG. 7, once the buttons 602 or inserts 602 are adhered to the inside diameter of the mold sleeve 600, the inner cylindrical structure 300 may be placed within the mold sleeve 600 such that the buttons/inserts 602 are positioned immediately over the blades 104 of the inner cylindrical structure 300. A series of channel formers 700 (e.g., sand formers 700) may be placed in the channels 106 of the inner cylindrical structure 300 to form the waterways 106 or channels 106 in the turbine sleeve 100. The remaining voids 702 may then be infiltrated with a matrix material (e.g., tungsten carbide matrix) to form the blades 104 of the turbine sleeve 100. This process will be explained in more detail hereafter. Once the turbine sleeve 100 is fabricated, the mold sleeve 600 may be broken up and removed from the outer circumference of the turbine sleeve 100, leaving the buttons/inserts 602 embedded within the blades 104.

Figure 8:
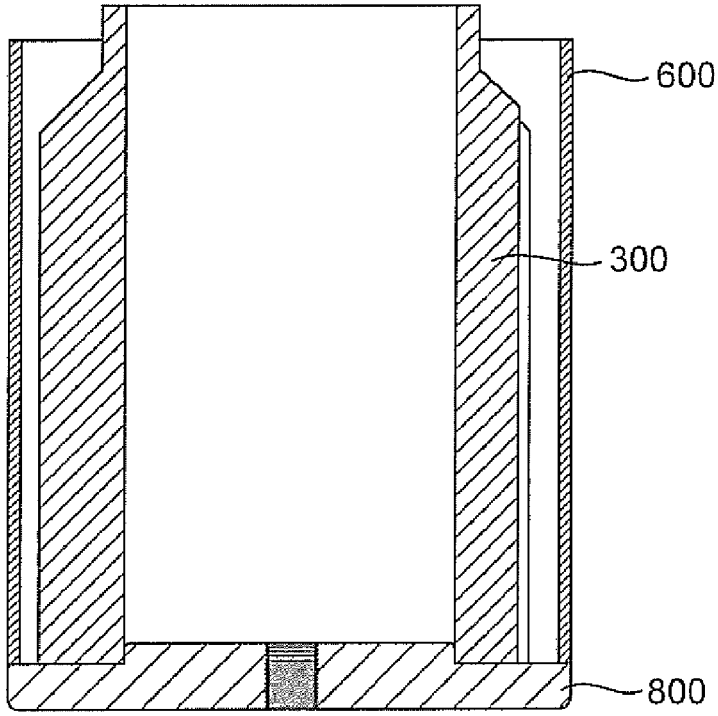
FIG. 8 is a cross-sectional side view of the mold sleeve and inner cylindrical structure sitting on a base fixture.

Referring to FIG. 8, in selected embodiments, a method for fabricating a turbine sleeve 100 in accordance with the invention may include initially cleaning the inner cylindrical structure 300 to ensure that corrosion, grease, and/or dirt are removed from the outside diameter thereof. The inner cylindrical structure 300 and mold sleeve 600 may then be placed on a base fixture 800. The base fixture 800 may help keep the inner cylindrical structure 300 and the mold sleeve 600 axially centered with respect to one another. As previously mentioned, the mold sleeve 600 may be oriented such that the buttons 602 or inserts 602 that are adhered to the sleeve 600 are positioned immediately over the blades 104 of the inner cylindrical structure 300. Ideally, the buttons 602 or inserts 602 are positioned some distance (e.g., 0.2 inches) away from the edge of the blades 104.

Figure 9:
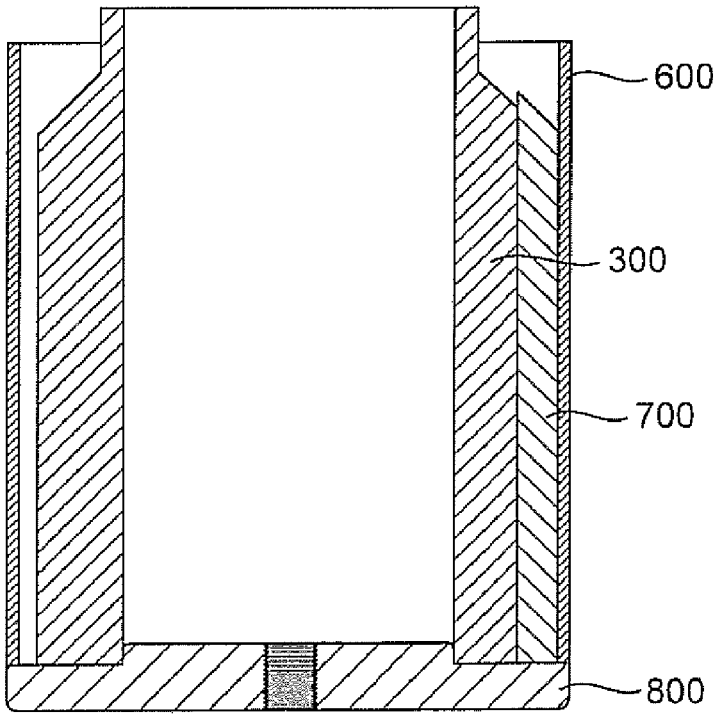
FIG. 9 is a cross-sectional side view of the mold sleeve and inner cylindrical structure sitting on a base fixture, along with sand formers to form channels along the turbine sleeve.

Referring to FIG. 9, the channel formers 700 may then be inserted into the channels 106 of the inner cylindrical structure 300. These channel formers 700 may create voids in the turbine sleeve 100 that will produce the waterways 106 or channels 106 along the turbine sleeve 100.

Figure 10:
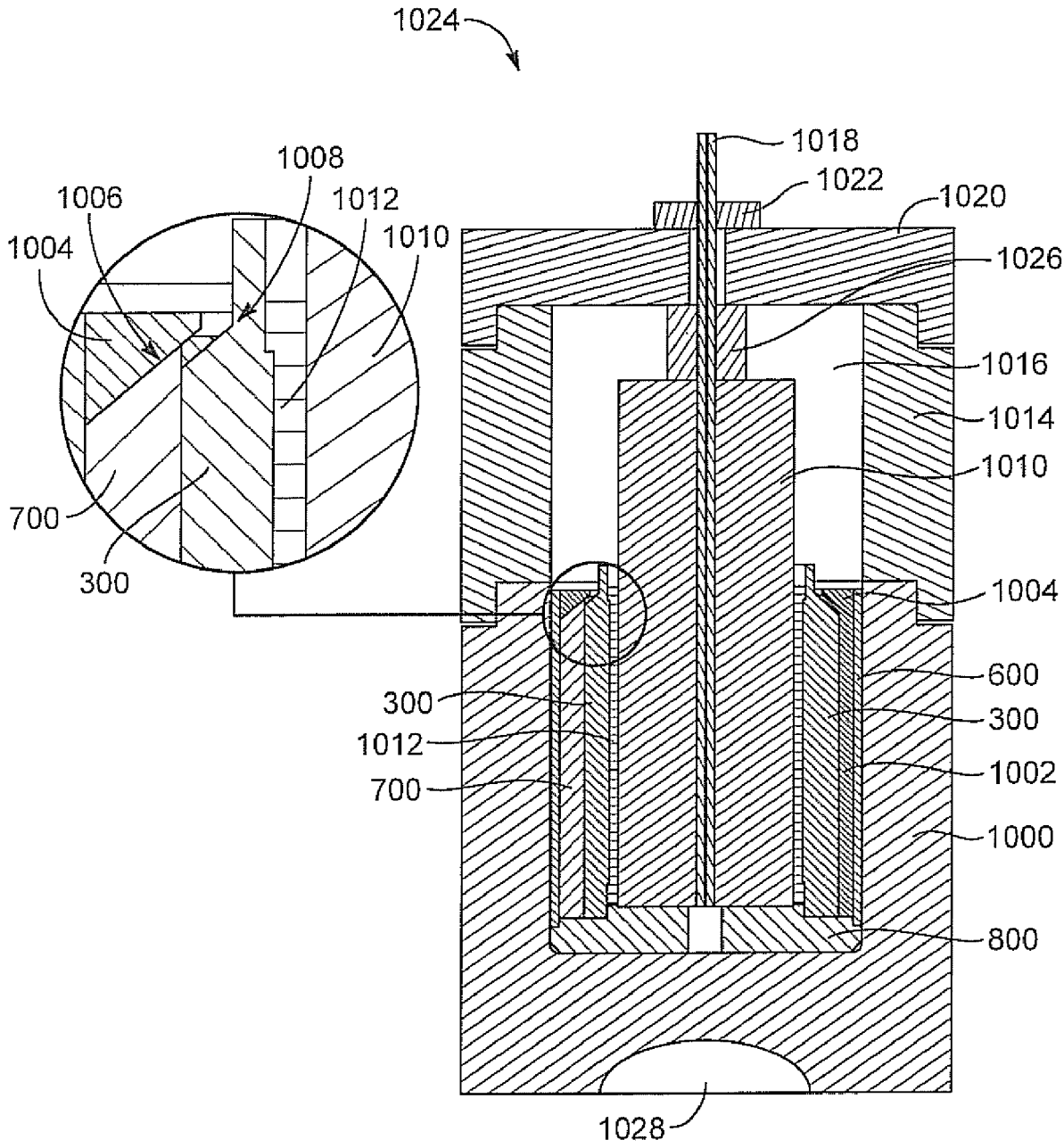
FIG. 10 is a cross-sectional side view of one embodiment of an assembly for fabricating the turbine sleeve.

Referring to FIG. 10, in selected embodiments, the assembly illustrated in FIG. 9 may then be placed into a mold pot 1000. In selected embodiments, the mold pot 1000, as well as a funnel member 1014 and lid 1020 may be fabricated from a heavy-grade graphite material and may be re-used when producing the turbine sleeve 100. A matrix powder, such as a tungsten carbide powder, may then be loaded into the voids 702 illustrated in FIG. 7. The matrix powder may be loaded to a depth (e.g., ⅛ inch) below a top surface of the channel formers 700. If needed, the entire structure may be vibrated to compact the matrix powder. If the matrix powder compacts below the depth previously measured, additional matrix powder may be loaded into the voids 702 to bring the matrix powder up to the previous depth. At this point an upreamer ring 1004 may be added to the structure immediately above the channel formers 700 and the powder 1002. The upreamer ring 1004 may provide a temporary form to ensure that the matrix material assumes the sloping back angle 1006.

Once the upreamer ring 1004 has been positioned, additional matrix powder may be loaded into the voids 702, such as at or near the corner 1008. A sand stalk 1010 may then be installed into the base fixture 800 and centered with respect to the inside diameter of the inner cylindrical structure 300. The sand stalk 1010 may keep the inside diameter of the inner cylindrical structure 300 free of powder and binder. If desired, a soft powder may be loaded into the space 1012 between the sand stalk 1010 and the inner cylindrical structure 300. This soft powder may create a soft material that may be machined away or broken up after the turbine sleeve 100 is fabricated.

Once the sand stalk 1010 is installed and soft powder is loaded between the sand stalk 1010 and the inner cylindrical structure 300, a funnel member 1014 may be attached to the top of the mold pot 1000. In selected embodiments, the funnel member 1014 may thread onto the mold pot 1000. The funnel member 1014 may provide a chamber 1016 where a binder material (e.g., a copper-based alloy) may be added. A lid 1020 may cover the top of the funnel member 1014. In certain embodiments, the lid 1020 may also thread onto the funnel member 1014. In selected embodiments, a thermocouple protection tube 1018 may extend through the lid 1020, through a smaller sand stalk 1026, and through the larger sand stalk 1010. A thermocouple (not shown) may extend through the thermocouple protection tube into the assembly 1024 to measure the assembly's internal temperature when heated. A thermocouple cap 1022 may fit over the thermocouple tube 1018 and rest on the lid 1020.

Once the assembly is complete, the entire assembly may be placed in a furnace and heated. For example, the assembly may be heated to temperature of about 1200° C. for about 3 hours. The heat will cause the binder in the chamber 1016 to melt and flow (in response to gravity and surface tension) into the matrix powder 1002 in the assembly 1024.

At the end of the heating cycle, the assembly 1024 may be removed from the furnace and cooled. This may be accomplished by placing the assembly on a cooling table and directing a stream of water into a quench cavity 1028 on the bottom of the mold pot 1000. By controlling the flow rate of the water stream, the cooling rate of the assembly 1024 may be controlled. As the assembly 1024 cools, the binder that has infiltrated the matrix powder 1002 will begin to solidify from the bottom up, thereby creating the solidified matrix material on the blades 104. Solidifying the matrix material in an upward direction may ensure that liquid metal is available to fill any porosity in the matrix powder as the matrix shrinks and solidifies.

After the assembly 1024 cools sufficiently, the turbine sleeve 100 (which may include the inner cylindrical structure 300 and the solidified matrix material 1002) may be removed from the assembly 1024. The sand stalk 1010, mold sleeve 600, and upreamer ring 1004 may be mechanically broken up and removed from the turbine sleeve 100. The resulting turbine sleeve 100 may then be machined as needed to assume its final contour and shape.

The apparatus and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An apparatus comprising:

an inner cylindrical structure made up of a first material, the inner cylindrical structure comprising a plurality of blades and a plurality of channels running between the blades along an outside diameter thereof;

the inner cylindrical structure further comprising threads extending into an outer surface of the plurality of blades; and an outer layer made up of a second material different from the first material, the outer layer being integrally bonded to the outer surface and the threads such that an interface is defined therebetween, the threads increasing the surface area of the interface to create a mechanical lock between the outer layer and the inner cylindrical structure.

2. The apparatus of claim 1, wherein the blades are one of:

(1) substantially parallel to an axis of the inner cylindrical structure; and (2) helical with respect to an axis of the inner cylindrical structure.

3. The apparatus of claim 1, wherein the first material is steel and the second material is a matrix material.

4. The apparatus of claim 3, wherein the matrix material is a tungsten carbide matrix material.

5. The apparatus of claim 1, wherein the second material is harder than the first material.

6. The apparatus of claim 1, wherein the plurality of blades are characterized by a blade height, and the outer layer makes up about 5 to 95 percent of the blade height.

7. The apparatus of claim 6, wherein the outer layer makes up about 30 percent of the blade height.

8. The apparatus of claim 1, further comprising at least one of PDC inserts, diamond inserts, natural diamonds, and TSP inserts embedded within the outer layer.

9. The apparatus of claim 1, wherein the threads are one of right-hand threads and left-hand threads.

10. A method comprising:

providing an inner cylindrical structure made up of a first material;

forming a plurality of blades and a plurality of channels running between the blades along an outside diameter of the inner cylindrical structure;

forming threads extending into an outer surface of the plurality of blades; and integrally bonding an outer layer made up of a second material different from the first material to the outer surface and the threads such that an interface is defined therebetween, the threads increasing the surface area of the interface to create a mechanical lock between the outer layer and the inner cylindrical structure.

11. The method of claim 10, wherein forming a plurality of blades comprises forming a plurality of blades that are one of:

(1) substantially parallel to an axis of the inner cylindrical structure; and (2) helical with respect to an axis of the inner cylindrical structure.

12. The method of claim 10, wherein the first material is steel and the second material is a matrix material.

13. The method of claim 12, wherein the matrix material is a tungsten carbide matrix material.

14. The method of claim 10, wherein the second material is harder than the first material.

15. The method of claim 10, wherein the plurality of blades are characterized by a blade height, and the outer layer makes up about 5 to 95 percent of the blade height.

16. The method of claim 15, wherein the outer layer makes up about 30 percent of the blade height.

17. The method of claim 10, further comprising embedding at least one of PDC inserts, natural diamonds, diamond inserts, and TSP inserts into the outer layer.

18. The method of claim 10, wherein forming threads on the outer surface of the plurality of blades comprises forming one of right-hand threads and left-hand threads.

19. An apparatus comprising:

an inner cylindrical structure made up of a first material, the inner cylindrical structure comprising threads extending into an outer surface thereof;

an outer layer made up of a second material different from the first material, the outer layer integrally bonded to the outer surface and the threads such that an interface is defined therebetween, the threads increasing the surface area of the interface to create a mechanical lock between the outer layer and the inner cylindrical structure; and a plurality of blades and a plurality of channels running between the blades formed on an outer surface of the outer layer.

20. The apparatus of claim 19, wherein the blades are one of:

(1) substantially parallel to an axis of the inner cylindrical structure; and (2) helical with respect to an axis of the inner cylindrical structure.

21. The apparatus of claim 19, wherein the first material is steel and the second material is a matrix material.

22. The apparatus of claim 21, wherein the matrix material is a tungsten carbide matrix material.

23. The apparatus of claim 19, further comprising at least one of PDC inserts, diamond inserts, natural diamonds, and TSP inserts embedded within the outer layer.

24. The apparatus of claim 19, wherein the threads are one of right-hand threads and left-hand threads.

* * * * *